United States Patent [19]

Barmatz et al.

[11] Patent Number: 4,777,823

[45] Date of Patent: Oct. 18, 1988

[54] CONTROLLED SAMPLE ORIENTATION AND ROTATION IN AN ACOUSTIC LEVITATOR

[75] Inventors: Martin B. Barmatz; Mark S. Gaspar, both of Glendale; Eugene H. Trinh, Los Angeles, all of Calif.

[73] Assignee: The United States of America as represented by the Administrator of the National Aeronautics and Space Administration, Washington, D.C.

[21] Appl. No.: 87,359

[22] Filed: Aug. 20, 1987

[51] Int. Cl.[4] ..... G10K 15/00

[52] U.S. Cl. ..... 73/505

[58] Field of Search ..... 73/505; 188/268; 373/10; 65/2; 198/805; 364/400; 432/58

[56] References Cited

U.S. PATENT DOCUMENTS

| | | | |
|---|---|---|---|
| 3,232,120 | 2/1966 | Ensley | 73/505 |
| 4,139,806 | 2/1979 | Kanber et al. | 318/116 |
| 4,218,921 | 8/1980 | Oran et al. | 73/505 |
| 4,284,403 | 8/1981 | Rey | 432/1 |
| 4,393,706 | 7/1983 | Barmatz | 73/505 |
| 4,402,221 | 9/1983 | Lee et al. | 73/505 |
| 4,420,977 | 12/1983 | Elleman et al. | 73/505 |
| 4,573,356 | 3/1986 | Barmatz et al. | 73/505 |
| 4,615,760 | 10/1986 | Dressler | 156/620 |

OTHER PUBLICATIONS

R. R. Whymark, "Acoustic Field Positioning for Containerless Processing," Ultrasonics, Nov., 1975, pp. 251-261.

*Primary Examiner*—Jerry W. Myracle
*Assistant Examiner*—Robert P. Bell
*Attorney, Agent, or Firm*—Paul F. McCaul; John R. Manning; Thomas H. Jones

[57] ABSTRACT

A system is described for use with acoustic levitators, which can prevent rotation of a levitated object or control its orientation and/or rotation. The acoustic field is made nonsymmetrical about the axis of the levitator, to produce an orienting torque that resists sample rotation. In one system, a perturbating reflector is located on one side of the axis of the levitator, at a location near the levitated object. In another system, the main reflector surface towards which incoming acoustic waves are directed is nonsymmetrically curved about the axis of the levitator. The levitated object can be reoriented or rotated in a controlled manner by repositioning the reflector producing the nonsymmetry.

20 Claims, 3 Drawing Sheets

FIG. 1
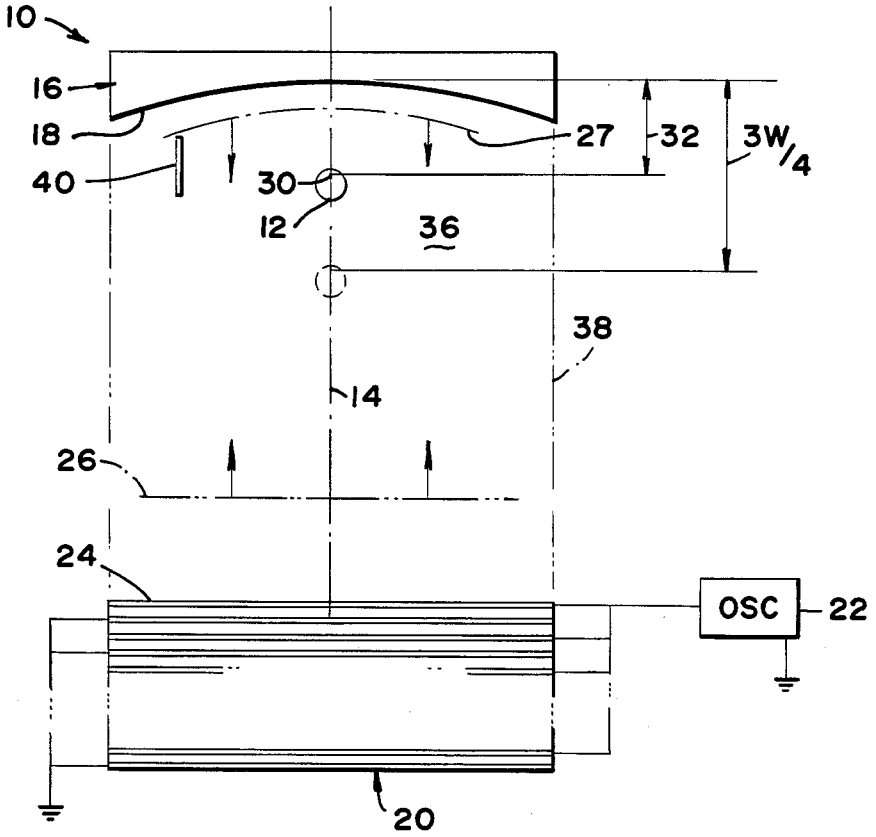
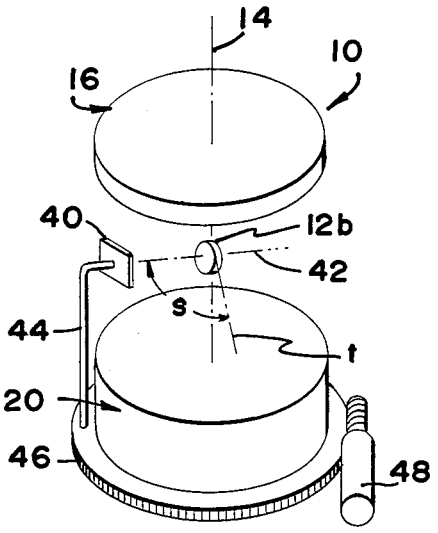
FIG. 1A
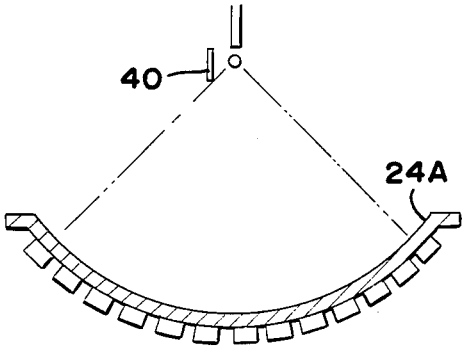
FIG. 2

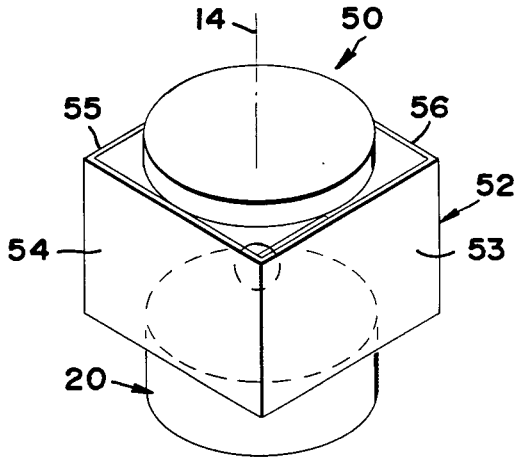
FIG. 3
FIG. 4
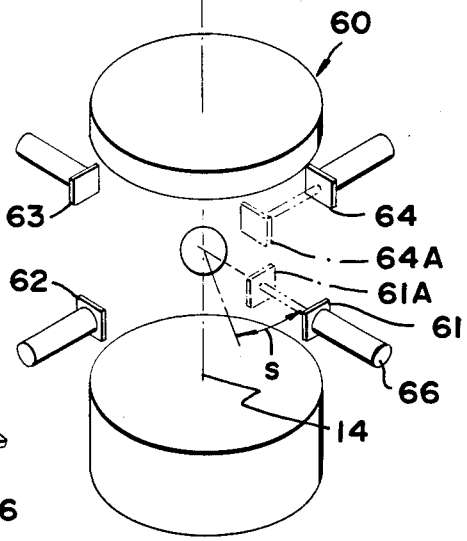
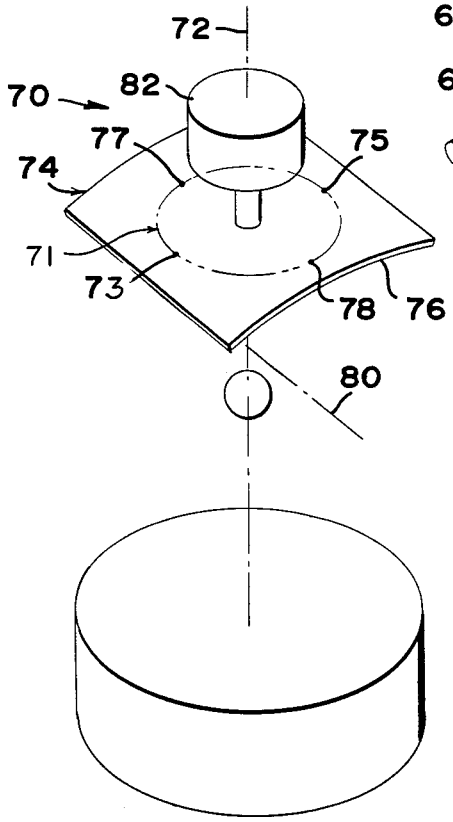
FIG. 5

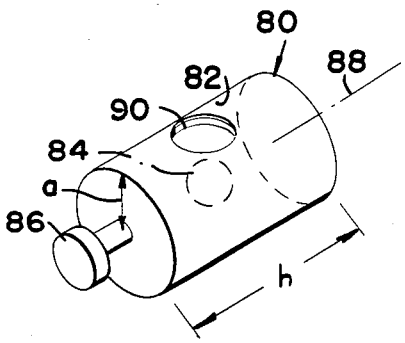
FIG. 6
FIG. 7
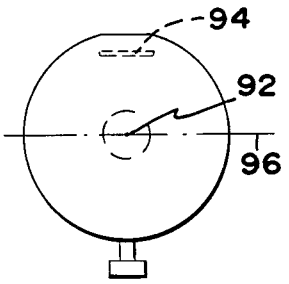
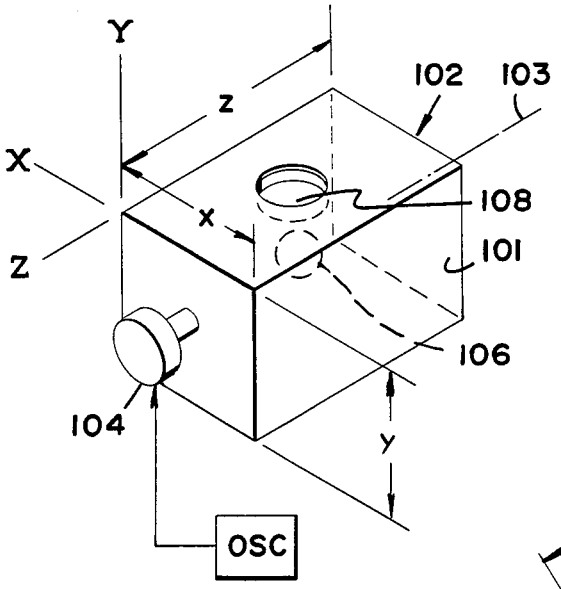
FIG. 8
FIG. 9
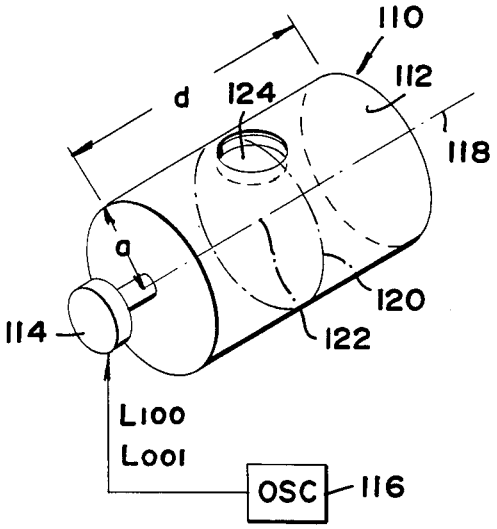

CONTROLLED SAMPLE ORIENTATION AND ROTATION IN AN ACOUSTIC LEVITATOR

ORIGIN OF THE INVENTION

The invention described herein was made in the performance of work under a NASA contract, and is subject to the provisions of Public Law 96-517 (35 USC 202) in which the Contractor has elected not to retain title.

BACKGROUND OF THE INVENTION

A single axis levitator often includes a pair of facing walls spaced along the axis of the levitator, with one wall generally being flat and vibrated by a transducer and the other wall being a concave reflector. An object tends to be levitated along the axis, at locations spaced from the concave reflector that are odd multiples of a quarter wavelength of the acoustic energy. The interference between the incoming plane wave approaching the reflector and the curved wave reflected therefrom results in an acoustic well or levitation location centered on the axis. Additional ring-shaped levitation locations are produced about the on-axis location, but are relatively weak, and the on-axis levitation location is generally of greatest importance. The levitation force is strongest along the levitation axis and is typically about one-tenth as great in a perpendicular direction. Thus, in a one-G gravity environment, which exists on the Earth's surface, the levitation axis is usually vertical.

In an ideal single axis levitation system which is symmetric about the levitation axis, there is no angular torque tending to orient the sample about the axis. However, in actual single axis levitators, there is generally sufficient assymmetry to produce small angular torques, which can initially orient the sample at low sound field levels. However, when more intense sound fields are established, they generate fluid flows such as turbulence or acoustic streaming, which can produce torques that rotate the sample. A similar situation exists in single mode resonant levitators of cylindrical, spherical and rectangular types wherein the levitating mode results in axial symmetry. It would be desirable to controllably produce orienting torques that could counteract such fluid-flow caused torques to orient or rotate the object.

SUMMARY OF THE INVENTION

In accordance with one embodiment of the present invention, a single axis or single mode acoustic levitator is provided which enables control of the orientation and/or rotation of a nonspherical levitated object. The acoustic levitator is constructed to provide an acoustic energy field near a location where an object is levitated, which is nonsymmetric with respect to the axis of the levitator. The nonsymmetry results in the creation of an orienting torque on the levitating object which resists its rotation relative to the acoustic field. The orientation or rotation of the object can be controlled by controlling rotation of the nonsymmetric field about the levitator axis.

In one levitator, a reflector is positioned a distance from the levitator axis and oriented to reflect acoustic energy generally towards the object location in a manner nonsymmetric about the levitator axis. In another embodiment of the invention, the levitator includes a concave main reflecting surface which is nonuniformally curved about the axis, as by using a surface which is part of a cylinder curved about an axis of curvature which is perpendicular to the levitator axis.

The novel features of the invention are set forth with particularity in the appended claims. The invention will be best understood from the following description when read in conjunction with the accompanying drawings.

BRIEF DESCRIPTION OF THE DRAWINGS

FIG. 1 is a simplified sectional and elevation view of a single axis levitator constructed in accordance with the present invention.

FIG. 1A is a perspective view of the levitator of FIG. 1.

FIG. 2 is a side elevation view of a levitator constructed in accordance with another embodiment of the invention.

FIG. 3 is a perspective view of a levitator constructed in accordance with another embodiment of the invention.

FIG. 4 is a perspective view of a levitator constructed in accordance with another embodiment of the invention.

FIG. 5 is a perspective view of a levitator constructed in accordance with another embodiment of the invention.

FIG. 6 is a sectional side view of a cylindrical single mode levitator, constructed in accordance with another embodiment of the invention.

FIG. 7 is a side elevation view of a spherical single mode levitator, constructed in accordance with another embodiment of the invention.

FIG. 8 is a perspective view of a square cross-section parallelepiped levitator, constructed in accordance with another embodiment of the invention.

FIG. 9 is a perspective view of a cylindrical dual mode levitator, constructed in accordance with another embodiment of the invention.

DESCRIPTION OF THE PREFERRED EMBODIMENTS

FIGS. 1 and 1A illustrate a single axis levitator 10 which levitates an object 12 (or **12*b* in FIG. 1A) at a location along an axis 14. The levitator includes a main reflector 16 lying on the axis 14, and having an acoustic reflecting surface 18 facing the object. The levitator also includes a transducer 20 such as a piezoelectric type driven by an oscillator 22 which vibrates a wall or surface 24. The surface 24 is located along the levitator axis 14, to apply incoming acoustic energy travelling largely along the axis towards the main reflector; that is, whether the acoustic energy wave front is plane or curved, it is approximately centered on the levitator axis 14. In the particular levitator of FIG. 1 where the main reflector surface 18 is concave and the acoustic energy generating surface 24 is flat, the vibrating surface 24 creates incoming plane waves indicated at 26, which are reflected off the concave surface 18 to produce a curved reflected wave front indicated at 27**.

The incoming wave 26 and the reflected wave 27 interfere to produce a levitation location at 30, which is spaced a distance 32 equal to W/4, where the W is the wavelength of the acoustic energy created by the transducer. Additional levitation points along the axis 14 are at odd multiples of W/4, with the greatest levitation force being at the levitating point 30 closest to the main reflector. In a gravity environment, such as exists on the Earth's surface, the object is urged towards the point 30, but actually lies a distance below that point. The interfering wave fronts not only resist movement of the object along the levitation axis 14, but also resist movement perpendicular to the axis, although the maximum levitating force perpendicular to the axis may be one-tenth as much as along the axis. When used on the Earth's surface, the axis 14 is generally substantially vertical with the main reflector lying above the generating surface.

Single axis levitators such as shown in FIG. 1 have a relatively low resonance quality factor Q, which is proportional to the ratio of levitation force to power output of the transducer. The Q of a single axis levitator without side walls and without care being taken to maintain resonant conditions, may be about five or less, as compared to about one hundred for a resonant chamber. Where the distance between surfaces 18, 24 is a multiple of the half wavelength of the acoustic energy, so there is resonance, the Q can be increased to about thirty. However, the single axis levitator has the advantage that there is free access to the levitation space, and the levitator is relatively simple. It may be noted that the output of the transducer does not have to be a plane wave, but as disclosed in U.S. Pat. No. 4,402,221, the lower vibrating surface may be concavely curved as shown at 24A in FIG. 2. A single axis levitator may be formed as in FIG. 1 but with cylindrical side walls indicated at 38, and is then a resonant single axis levitator but with limited access to the object.

Due to the theoretical symmetry of the levitator of FIG. 1 about the levitation axis 14, there would appear to be no angular force urging the object 12 to rotate. However, in real single axis levitators, there is generally sufficient assymmetry to orient the object at low sound field levels. When more intense sound fields are required, flows of the fluid or gas 36 in the levitator, generally associated with turbulence or acoustic streaming, can produce angular torques that rotate the sample. A technique which enabled the production of an orienting torque that urged the sample towards a particular orientation with sufficient torque to overcome the streaming torque, would enable control of the angular orientation of the object.

In accordance with the present invention, significant assymmetry of the acoustic field is established, which produces an orienting torque (on nonspherical objects) that resists object rotation more than torques associated with fluid flow urge object rotation. One approach to the production of such assymmetry is the positioning of one or more reflectors such as perturbating reflector 40 at a location spaced from the levitation axis 14, and near the height of the levitated object 12, or in other words, about as far from the main reflector as the levitation location. The perturbating reflector reflects acoustic energy from a particular angular orientation "s" (FIG. 2) relative to a fixed direction "t" about the axis, primarily towards the levitation axis and generally towards the object by facing in the general direction of the levitation location. Sound waves reflected from this perturbating reflector 40 impinge upon the sample, in essentially the same manner as a new sound source located at 40. As previously demonstrated by Lord Rayleigh, a nonspherical sample will orient itself in a sound field with the normal to its largest cross sectional area lying along the sound field direction. The restoring torque is stronger for a larger reflector or for a more focused reflector sound field at the sample. As an example, for a sample **12*b* in the shape of a short cylinder, the sample will orient itself so that the sample axis 42 normal to its largest cross sectional area will be directed generally towards the reflector 40. It is possible to provide an acoustic transducer at the location of reflector 40** instead of the reflector.

Where it is desired to control the orientation of the sample, and change the orientation, the reflector 40 can be held so it can be rotated about the levitation axis 14. In FIG. 1A, a post 44 holds the reflector on a turntable 46, that is rotated by a motor 48 to enable the sample to be rotated to any orientation about the levitation axis.

FIG. 3 illustrates another apparatus 50 for controlling sample rotation, wherein a nonaxisymmetric reflector 52 is used which surrounds the levitation axis 14, and which includes four large reflector walls 53–56 whose internal cross section as viewed from the top is a square. This particular reflector 52 extends 360° continuously about the levitator axis, but the reflector is not symmetric because there is a reflector surface closer in certain angular directions about the axis than at other directions.

FIG. 4 illustrates another single axis levitator apparatus 60 which includes four small reflectors 61–64 spaced 90° about the levitation axis 14. An actuator 66 coupled to each reflector can move it radially to lie close to the levitator axis to create substantial assymmetry in the acoustic field at that reflector angle S about the axis. For example, the reflector 61 can be moved to the position 61A. To turn the sample by 90°, the reflector 64 can be advanced to the position 64A while the reflector 61 is retracted. When rotation of the sample is desired, reflectors progressively spaced about the axis can be progressively moved radially inward and then withdrawn.

FIG. 5 illustrates another apparatus 70 wherein angular symmetry of the sound field about the axis 72 is broken by the use of an asymmetric main reflector 74. In the particular reflector 74, the reflecting surface 76 is a portion of a cylinder whose axis of curvature such as 80 is perpendicular to the levitator axis 72. Incoming acoustic energy is nonuniformally reflected so that reflected energy intensity is nonuniform about said axis. The interference between the incoming and reflected ssound waves will lead to a force field whose intensity varies about the levitation axis. The more asymmetric is the shape of the main reflector 74, the stronger will be the retarding torque. A motor 82 is shown coupled to the main reflector 74 to enable rotation of the reflector and therefore of the sample. Although a largely cylindrical surface can be used, a variety of main reflector surfaces can be used, where the surface is nonsymmetrically curved about the axis 72; that is, some imaginary circles such as 71 which are coaxial with the axis 72 and which include some points 73, 75 on the reflector surface, also include other points 77, 78 spaced forward or rearward of the reflector surface.

FIG. 6 illustrates another levitator 80 which includes walls forming a resonant cylindrical chamber 82 that substantially completely surrounds the object 84. The acoustic energy from a transducer 86 is of a single levitation mode which is axisymmetric with respect to the cylindrical axis 88. Such a levitator can have a high Q such as 100, but there is more limited access to the levitated object. As described in U.S. Pat. No. 4,573,356, such a resonant mode is obtained by applying acoustic energy of a wavelength $L_{o1n}$ where $$L_{01n} = \frac{2a}{[1.488 + n^2(a/h)]^{2}} \quad \frac{(1 + 1.29\ V_s)}{V_c}$$

where a is the radius of the cylinder, h is the length of the cylinder, $V_s$ is the volume of the sample (where the sample volume is less than about 20% of chamber volume), and $V_c$ is the chamber volume. The presence of a nonsymmetrical perturbating reflector 90 results in orienting the object. A similar symmetric condition occurs in single mode levitating in a spherical chamber, as shown in FIG. 7, where point 92 is the center of the chamber. A similar perturbating reflector 94 avoids object rotation with respect to an axis 96 symmetric to the chamber.

FIG. 8 illustrates a single-mode levitator 102 with a chamber 101 of parallelepiped shape having equal dimensions in the X and Y (width and depth) directions to provide a square cross-section along an axis 103 extending along the length of the chamber. A transducer 104 excites the chamber in a 22*n* mode wherein the wavelength $L_{22n}$ is given by:

$$L_{22n} = \frac{2x}{[8 + (x/z)^2\ n^2]^{\frac{1}{2}}} \quad \frac{(1 + 1.29\ V_s)}{V_c}$$

where x is the chamber length in the X and Y dimensions, z is the chamber length in the Z dimension, n equals one or more, and $V_s$ and $V_c$ are respectively the object volume and the chamber volume. Where n=1, levitation is at the center of the chamber. The square cross-section for these modes produces an essentially symmetric force field around the axis and around the object 10G in the XY plane, similar to the cylindrical case of FIG. 6. A perturbating reflector 108 avoids object rotation.

A perturbating reflector can be useful to avoid object rotation in a variety of resonant levitators where more than one more is excited simultaneously, but the acoustic field is symmetric about an axis. Such symmetry can result in uncontrolled rotation in the absence of such a reflector. FIG. 9 illustrates such a levitator 110, which includes a cylindrical chamber 112 and a transducer 114 that is excited by an oscillator 116 at two frequencies that produce two resonant wavelengths $L_{100}$ and $L_{001}$. Two oscillators coupled to the opposite ends of the chamber, each driven at a different one of the frequencies, can be used to produce greater leviation pressure. The wavelength $L_{100}$ produces levitation along the axis 118 of the chamber, but does not prevent object drift along this axis. The wavelength $L_{001}$ produces levitation along the plane 120, but does not prevent object drift along this plane. The two modes hold the object near the combined levitation location 122, but do not prevent object rotation. A perturbating reflector 124 avoids object rotation. The equations for $L_{100}$ and $L_{00n}$ (where n can equal 1 or more to establish one or more levitation planes) are give by:

$$L_{100}=3.41a$$

$$L_{00n}=2d/n$$

where a is the radius of the chamber, d is the length of the chamber, and n is at least 1. The cylindrical chamber may be described as having a length d and having a width and depth that are both equal to 2a.

Thus, the invention provides a method and apparatus for controlling rotation of a nonspherical sample or object that is levitated in a single axis acoustic levitator, or in a single mode resonant levitator of cylindrical or spherical shape or square cross-section. The levitator is constructed to produce an asymmetry in the acoustic field about the levitation axis, to control orientation of the object. In one approach, one or more reflectors are asymmetrically positioned about the levitation axis to create asymmetric reflection of acoustic energy near the location where the object is levitated. In another approach, the main reflector of the levitator is made asymmetric. The amount of orienting torque increases as the orienting reflector surface area increases, or as the asymmetry of the main reflector increases. Usually, experiments determine the required size and position of the orienting reflector or nonsymmetry of the main reflector which enables control of sample orientation, and there is generally no benefit in using a larger orienting reflector or greater asymmetry in the main reflector.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. In a single axis acoustic levitator which has a main reflector lying on a predetermined axis, and means for applying incoming acoustic energy towards said main reflector for reflection therefrom, to levitate an object at a location spaced from said main reflector and near said axis, the improvement of means for controlling object rotation, comprising:

an acoustic perturbating reflector which is nonsymmetric about said axis, and which is located a distance from said axis and oriented to reflect acoustic energy primarily towards said axis, to make the acoustic field nonsymmetric about said axis and thereby resist object rotation relative to said perturbating reflector.

2. The improvement described in claim 1, including:

means coupled to said perturbating reflector for moving it to different positions about said axis, whereby to enable controlled object orientation and rotation.

3. The improvement described in claim 1 wherein:

said main reflector is concave, and said means for applying acoustic energy includes a wall spaced along said axis from said main reflector, and means for vibrating said wall along said axis.

4. The improvement described in claim 1 wherein:

said perturbating reflector is located about as far from said mean reflector, as measured along said axis, as said object levitation location, and said perturbating reflector has a surface that substantially faces said object levitation location.

5. A single axis levitator comprising:

a main reflector lying on a predetermined axis and having a reflector surface facing in a first direction substantially along said axis;

means for applying incoming acoustic energy substantially opposite to said first direction toward said reflector surface;

said reflector surface being nonsymmetrically curved about said axis to reflect incoming acoustic energy so the reflected energy intensity is nonuniform about said axis.

6. The levitator described in claim 5 wherein:

said reflector surface is largely part of a cylinder whose cylindrical axis is spaced in said first direction from said reflector surface and which is substantially perpendicular to said predetermined axis.

7. The levitator described in claim 5 wherein:

said reflector surface is concave and said means for applying acoustic energy includes a substantially flat wall spaced along said axis from said first wall and means for vibrating said wall along said axis.

8. In a single mode resonant acoustic levitator for levitating an object, wherein the levitator includes walls that are substantially symmetric about an axis, with at least some walls spaced from said axis, and means for applying acoustic energy of a frequency which levitates the object against movement in all directions, the improvement of means for controlling object rotation, comprising:

an acoustic perturbating reflector which is nonsymmetric about said axis, and which is located a distance from said axis that is less than said walls which are spaced from said axis, and oriented to reflect acoustic energy primarily towards said axis, to make the acoustic field nonsymmetric about said axis and thereby resist object rotation relative to said perturbating reflector.

9. The improvement described in claim 8 wherein:

said levitator walls are cylindrical.

10. The improvement described in claim 8 wherein:

said levitator walls are spherical.

11. The improvement described in claim 8 wherein:

said levitator walls are of parallelepiped form with at least two dimensions being equal.

12. In an acoustic levitator which includes walls forming a chamber which has a width, depth, and length with the width and length being equal, which includes an imaginary axis extending along said length, and which includes means for establishing a resonant acoustic energy field in said chamber which urges livitation of an object on said axis, with said acoustic energy field being substantially symmetric about said axis, the improvement comprising:

an acoustic perturbating reflector which is nonsymmetric about said axis, and which is located a distance from said axis and oriented to reflect acoustic energy primarily towards said object on said axis, to make the acoustic field nonsymmetric about said axis and thereby resist object rotation relative to said perturbating reflector.

13. The improvement described in claim 12 wherein:

said chamber is of square cross-section along said axis, and said means for establishing includes a transducer coupled to said chamber and producing acoustic energy of a wavelength $L_{22n}$ substantially as given by:

$$L_{22n} = \frac{2x}{[8 + (x/z)^2 n^2]^{\frac{1}{2}}} \quad \frac{(1 + 1.29\, V_s)}{V_c}$$

where x is the chamber width and depth, z is the chamber length, n equals 1 or more, and $V_s$ and $V_c$ are respectively the object volume and the chamber volume.

14. The improvement described in claim 12 wherein:

said chamber is of cylindrical shape, with said axis being the axis of the cylindrical shape, and said means for establishing applies acoustic energy of two wavelengths $L_{00n}$ and $L_{100}$ to said chamber, substantially as given by:

$$L_{100} = 3.41a$$

$$L_{00n} = 2d/n$$

where d is the length of said chamber along said axis, a is the radius of the chamber, and n equals at least 1.

15. The improvement described in claim 12, including:

means coupled to said perturbating reflector for moving it to different positions about said axis, whereby to enable controlled object orientation and rotation.

16. A method for controlling the orientation and rotation of a levitated object, which is being levitated by an acoustic energy field in a single axis levitator wherein incoming acoustic energy is directed generally along a predetermined axis towards a main reflector surface and is reflected from the surface generally along said axis, comprising:

directing acoustic energy nonsymmetrically about said axis, generally towards said object, from a location spaced from said axis and from said reflector surface.

17. The method described in claim 16 wherein:

said step of directing includes establishing a perturbating reflector at said location.

18. The method described in claim 17, including:

moving said perturbating reflector about said axis, whereby to reorient or rotate the levitated object.

19. A method for levitating an object comprising:

directing acoustic energy generally along an axis toward a wall surface;

reflecting said acoustic energy from said wall surface in directions angled from the directions along which said acoustic energy was travelling as it reached said wall surface, including reflecting said acoustic energy in directions unsymmetric about said axis.

20. The method described in claim 19 wherein said step of reflecting includes establishing said wall surface so it is curved about a second axis that is perpendicular to said first mentioned axis.

* * * * *